US009016514B2

(12) United States Patent
Feldman et al.

(10) Patent No.: US 9,016,514 B2
(45) Date of Patent: Apr. 28, 2015

(54) BEVERAGE CONTAINER HOLDER

(71) Applicant: InchBug LLC, Austin, TX (US)

(72) Inventors: Brenda Lee Feldman, Austin, TX (US); Daniel Francis Caputo, Cedar Park, TX (US); Roy P. Prosise, Cedar Park, TX (US)

(73) Assignee: InchBug LLC., Austin, TX (US)

( * ) Notice: Subject to any disclaimer, the term of this patent is extended or adjusted under 35 U.S.C. 154(b) by 0 days.

(21) Appl. No.: 14/339,713

(22) Filed: Jul. 24, 2014

(65) Prior Publication Data

US 2015/0034663 A1 Feb. 5, 2015

Related U.S. Application Data

(60) Provisional application No. 61/860,054, filed on Jul. 30, 2013.

(51) Int. Cl.
*B65D 25/22* (2006.01)
*A47G 23/02* (2006.01)

(52) U.S. Cl.
CPC ..... *A47G 23/0216* (2013.01); *A47G 23/0225* (2013.01)

(58) Field of Classification Search
CPC ..... A47G 23/0225; A47G 23/0216
USPC ..... 220/8, 739, 470, 4.03, 4.06, 4.07, 4.21
See application file for complete search history.

(56) References Cited

U.S. PATENT DOCUMENTS

| | | | | |
|---|---|---|---|---|
| D149,866 | S | 6/1948 | Fry | |
| 4,724,976 | A | 2/1988 | Lee | |
| 4,986,435 | A | 1/1991 | Wright | |
| 5,052,575 | A | 10/1991 | Ravreby | |
| D329,357 | S | 9/1992 | Lebensfeld | |
| 5,150,811 | A | 9/1992 | Kelston | |
| 5,169,026 | A | 12/1992 | Patterson | |
| 5,292,021 | A | 3/1994 | Lyon | |
| 5,680,949 | A * | 10/1997 | Roesler | 220/8 |
| 5,950,857 | A | 9/1999 | Rosen | |
| 7,086,556 | B1 * | 8/2006 | Trulove-Cranor | 220/740 |
| D639,118 | S | 6/2011 | Huang | |
| 8,146,764 | B2 * | 4/2012 | Kral | 220/8 |
| D695,574 | S * | 12/2013 | Min et al. | D7/622 |
| 8,616,376 | B2 * | 12/2013 | Cronin | 206/540 |
| 2013/0277365 | A1 * | 10/2013 | Kaufman et al. | 220/8 |

OTHER PUBLICATIONS

U.S. Appl. No. 29/462,022, filed Jul. 30, 2013.

* cited by examiner

*Primary Examiner* — Steven A. Reynolds
*Assistant Examiner* — King M Chu
(74) *Attorney, Agent, or Firm* — Abel Law Group, LLP

(57) ABSTRACT

A beverage container holder may include a base having an interior compartment configured to support a beverage, and a flexible tab having a lock button extending therefrom. It may further include a housing configured to be mounted to the base such that the beverage is located between the base and the housing. The housing can have a lock hole configured to receive the lock button and secure the housing to the base. The housing also can have a release button separate and spaced apart from the lock hole. The release button may be configured to selectively engage the flexible tab without contacting the lock button to indirectly release the lock button from the lock hole.

20 Claims, 10 Drawing Sheets

BEVERAGE CONTAINER HOLDER

This application claims priority to and the benefit of U.S. Prov. Pat. App. No. 61/860,054, filed Jul. 30, 2013, and is incorporated herein by reference in its entirety.

BACKGROUND OF THE INVENTION

1. Field of the Disclosure

The present invention relates in general to beverages and, in particular, to a system, method and apparatus for a beverage container holder.

2. Description of the Related Art

There are a variety of different types of beverage container holders, such as juice box holders. For example, U.S. Design Pat. 329,357, discloses a beverage container holder, and U.S. Design Pat. 149,866, discloses a holder for a paper milk carton. U.S. Pat. No. 5,150,811, discloses a squeeze resistant holder for a juice box. The holder includes a hinged housing with an open top for inserting a straw into the top of the juice box. A stopper is included for covering a straw opening when the juice box is not in use.

Other references include U.S. Pat. No. 5,292,021, which describes a holder for a liquid package, and includes a hollow container with a hinged lid. The lid has sharp point for puncturing the top of the package and a mouthpiece for receiving a liquid from the punctured package. U.S. Pat. No. 5,052,575, includes a holder for an aseptic package having a container with a removable cover and stopper disposed under the cover for securing a straw hole. U.S. Pat. No. 5,950,857, discloses a liquid box holder for a juice box. The holder includes a lid with a drink spout, an air regulating valve and a fluid exit opening. U.S. Pat. No. 4,986,435, discloses a receptacle for a box-style flexible beverage container. The receptacle includes sidewalls, a bottom and an open top for receiving a beverage container. In addition, U.S. Pat. No. 7,086,556, discloses a two-piece beverage container holder with some adjustability. Although each of these designs is workable, improvements in beverage container holders continue to be of interest.

SUMMARY

Embodiments of a system, method and apparatus for a beverage container holder are disclosed. For example, a beverage container holder may include a base having an interior compartment configured to support a beverage, and a flexible tab having a lock button extending therefrom. It may further include a housing configured to be mounted to the base such that the beverage is located between the base and the housing. The housing can have a lock hole configured to receive the lock button and secure the housing to the base. The housing also can have a release button separate and spaced apart from the lock hole. The release button may be configured to selectively engage the flexible tab. The release button can be configured to not contact the lock button to indirectly release the lock button from the lock hole.

In another embodiment, a beverage container holder may comprise a base having an interior compartment configured to support a beverage, and a flexible tab having a lock button and a rib extending therefrom. A housing may be configured to be mounted to the base such that the beverage is located between the base and the housing, the housing having a lock hole configured to receive the lock button and secure the housing to the base, and a recess configured to slidingly receive the rib to align the housing on the base.

In still another embodiment, a beverage container holder may comprise a base having a flexible tab with a lock button, an interior compartment, and a plurality of interior platforms in the interior compartment configured to support a plurality of different sizes of beverages. In addition, a housing may be configured to be mounted to the base such that a selected one of the different sizes of beverages is located between the base and the housing, the housing having a lock hole configured to receive the lock button and secure the housing to the base.

The foregoing description and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
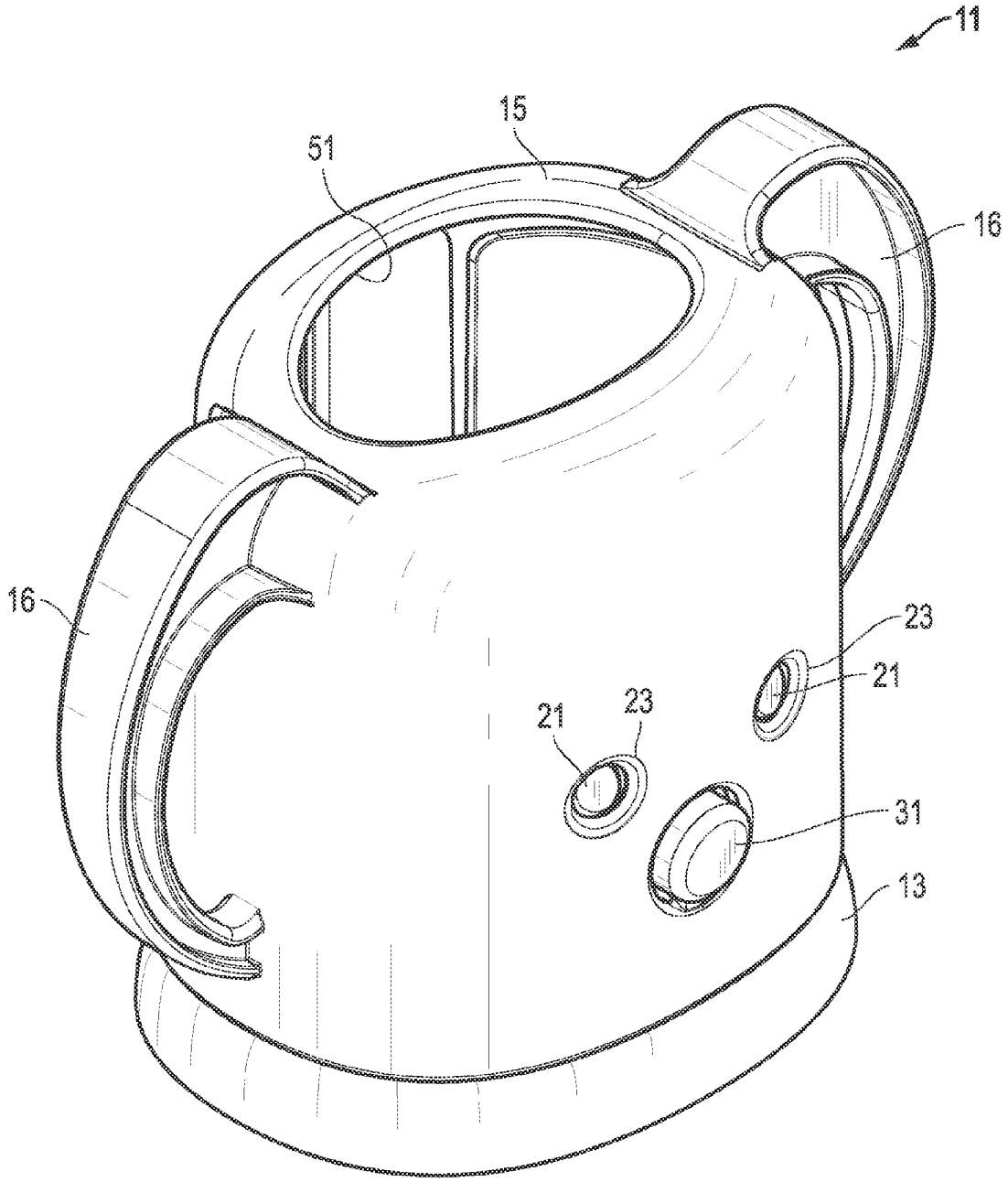
FIG. 1 is an isometric view of an embodiment of a beverage container holder in a first position.
Figure 2:
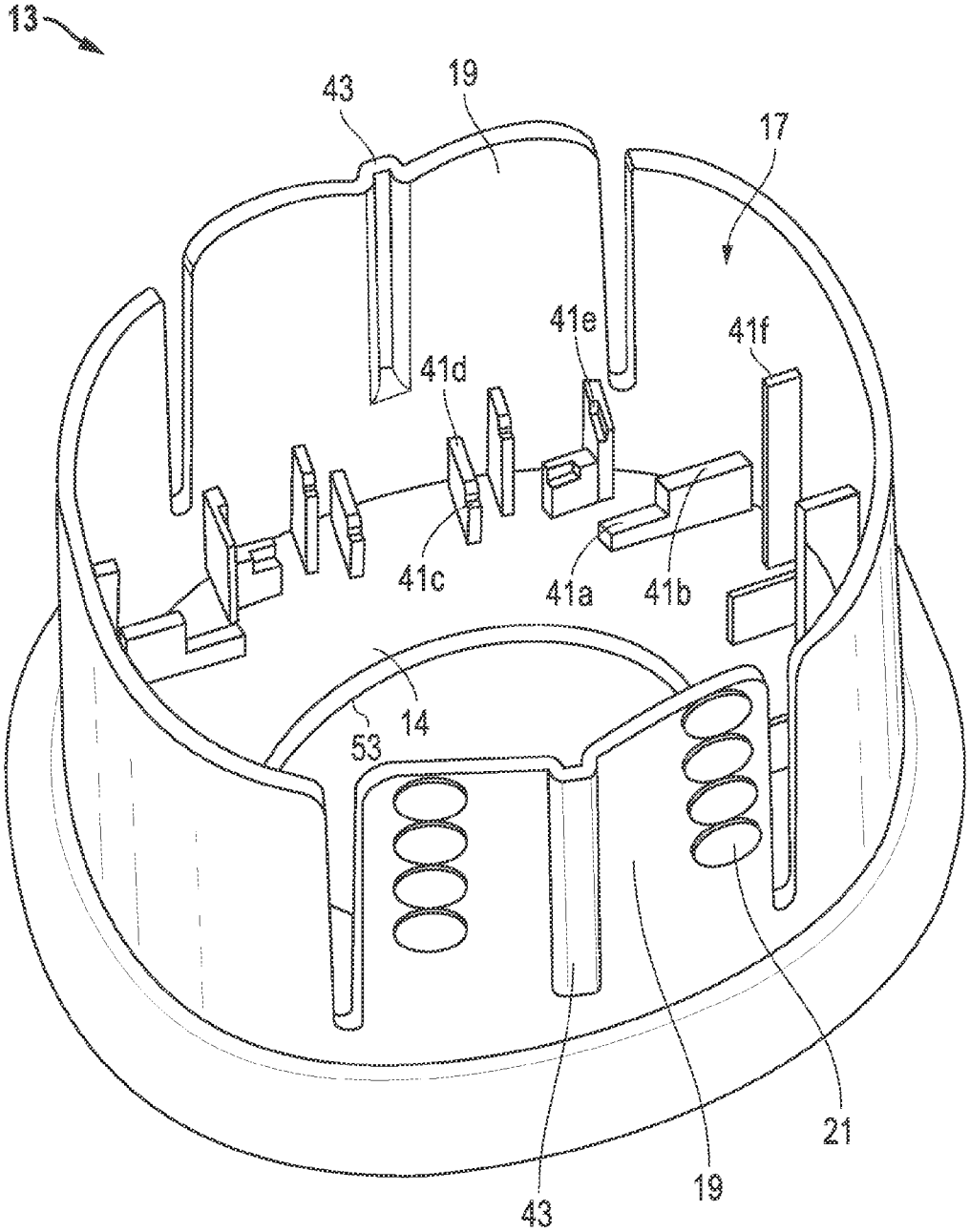
FIG. 2 is an upper isometric view of an embodiment of a base for a beverage container holder.
Figure 3:
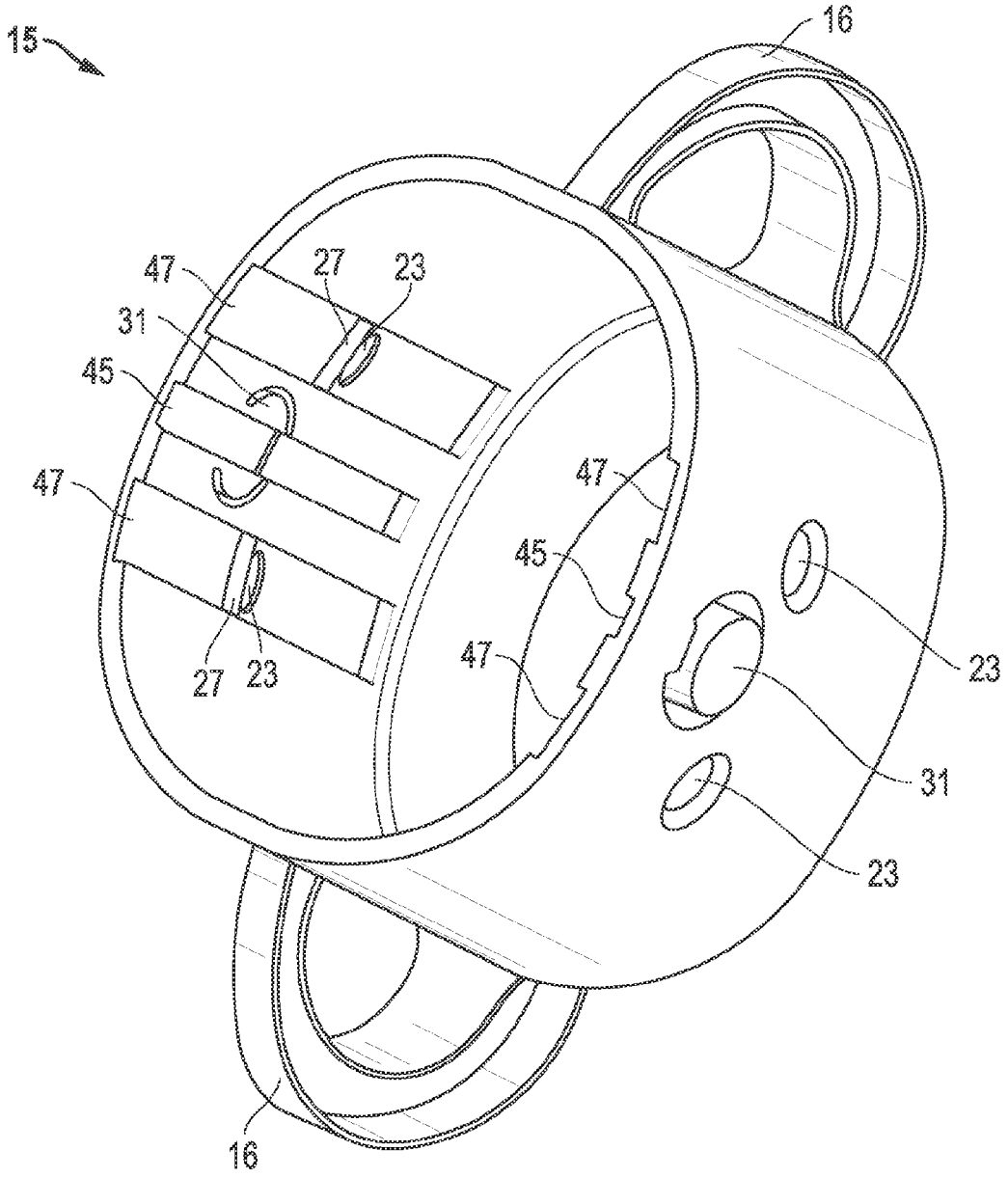
FIG. 3 is a lower isometric view of an embodiment of a housing for a beverage container holder.

Embodiments of a system, method and apparatus for a beverage container holder are disclosed. For example, as shown in FIGS. 1-3, an embodiment of a beverage container holder 11 may include a base 13 and a housing 15. Some versions of the base 13 include an interior compartment 17 (FIG. 2) that is configured to support a beverage container 101 (see, e.g., FIGS. 4 and 5) as described herein. Embodiments of the base 13 can include one or more flexible tabs 19 (e.g., two shown) that extend upward in a tongue-like fashion. The flexible tab 19 can include one or more (e.g., a plurality of) lock buttons 21 that extend outwardly therefrom. For example, eight lock buttons 21 are shown in FIG. 2, and there are eight more lock buttons 21 on the opposite side of base 13. Alternatively, the flexible tab 19 can have apertures or holes instead of lock buttons 21.

In some embodiments, the housing 15 may be configured to be mounted to the base 13. The beverage 101 may be located between the base 13 and the housing 15. Versions of the housing 15 can include one or more (e.g., a plurality of)

lock holes 23 (e.g., two shown). The lock holes 23 may be configured to receive and engage the lock buttons 21 to prevent further incidental movement of the base 13 relative to the housing 15. The lock holes 23 and lock buttons 21 may be used to selectively and temporarily secure the housing 15 to the base 13 in a desired position or configuration. Alternatively, the holes may in base 13 and the buttons may be on housing 15.

Embodiments may further include a release button 31. The release button 31 may be separate and spaced apart from the lock hole 23, as shown. The release button 31 can be configured to selectively engage the flexible tab 19. Versions of the release button 31 can engage flexible tab 19 without contacting the lock buttons 21. Thus, release button 31 can indirectly (e.g., without actually or directly touching them) release the lock buttons 21 from the lock holes 23. In a particular embodiment, the release button 31 may comprise a second flexible tab having a hinge 33 (e.g., best shown in FIG. 6).

Figure 4:
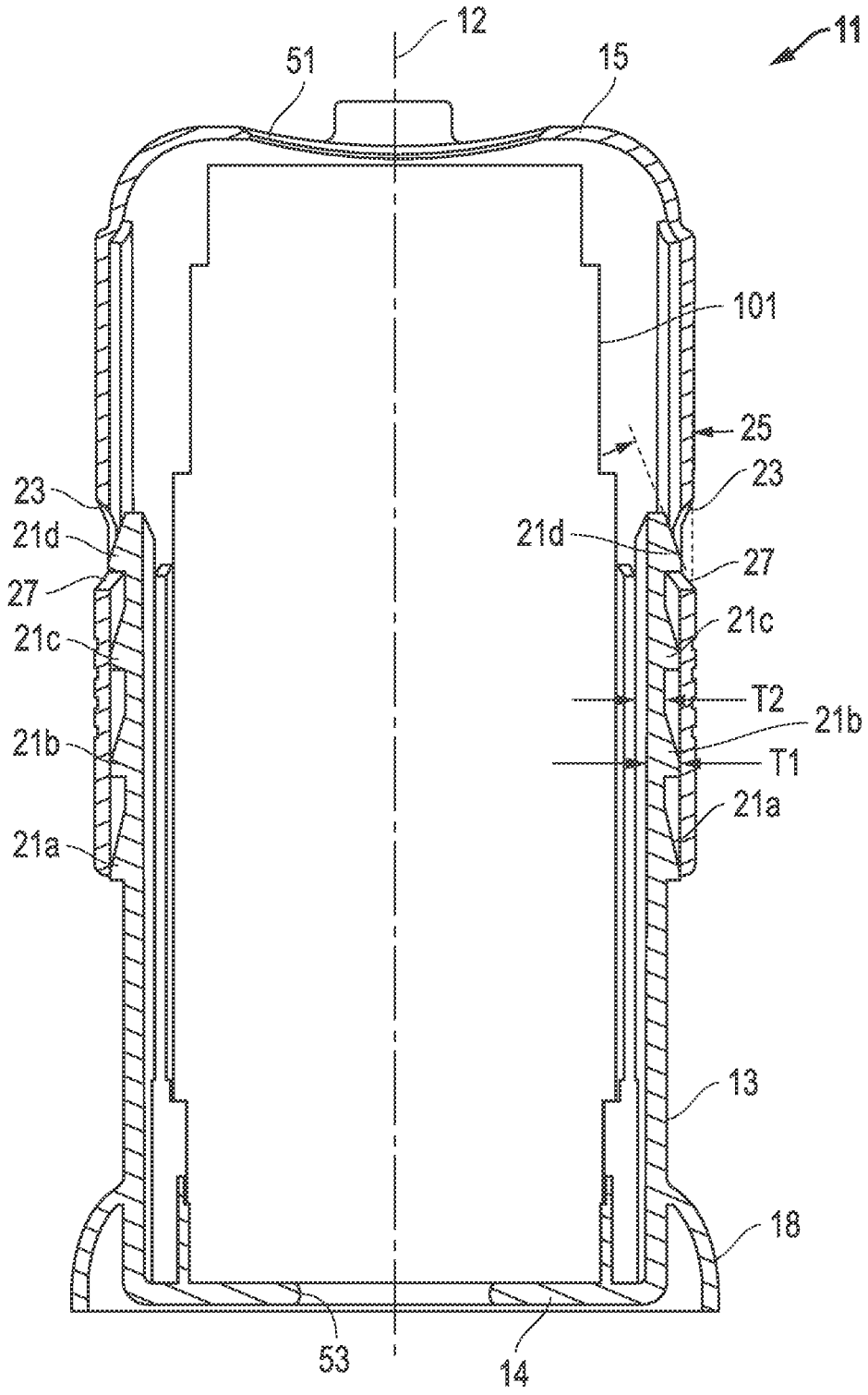
FIG. 4 is a sectional side view of an embodiment of a beverage container holder depicting containment of several different sizes of beverages.
Figure 5:
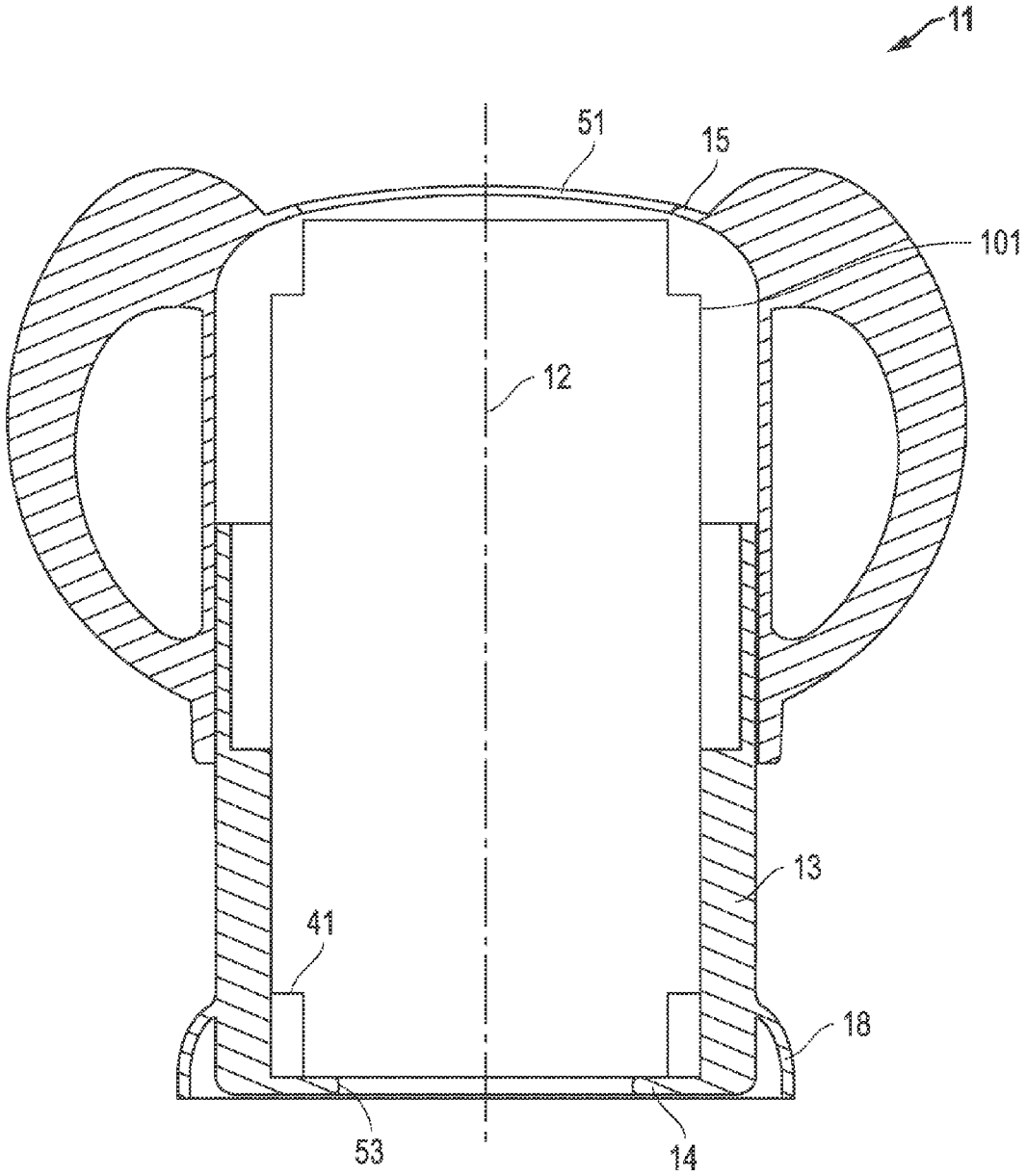
FIG. 5 is a sectional front view of an embodiment of a beverage container holder depicting containment of several different sizes of beverages.

In some embodiments, one or more of the lock buttons 21 may include a taper 25 (e.g., best shown in FIG. 4). Thus, one or more of the lock buttons 21 can have a first thickness T1 at a lower end thereof, and a second thickness T2 at an upper end thereof. The second thickness T2 can be less than the first thickness T1. In some versions of the beverage container holder 11, one or more of the lock buttons 21 and the lock holes 23 can be substantially cylindrical and tapered (e.g., best shown in FIG. 6).

Embodiments of the lock holes 23 may include a ramp 27 (e.g., best shown in FIGS. 3 and 4). In one example, the ramp 27 can extend into an interior of the housing 15 from its respective lock hole 23. The ramp can be configured to engage a lower end of a respective one of the lock buttons 23. Such engagement can prevent further upward motion of the housing 15 relative to the base 13. In addition, a small shoulder on an upper end of the lock buttons can engage an upper end of lock hole 23. Such engagement can prevent further downward motion of the housing 15 relative to the base 13. Thus, housing 15 can be selectively retained on base 13 in a variety of positions (e.g., four positions are illustrated in FIGS. 1 and 6-8).

In another example, the housing 15 may further comprise one or more handles 16 (e.g., two shown). In a particular version, a handle 16 may be on a first side (e.g., left or right side) of the beverage container holder 11. One or more of the lock buttons 21 and the lock holes 23 may be located on a second side (e.g., front side) of the beverage container holder 11 that is different than the first side. The first side may be substantially orthogonal (e.g., at 90 degrees) relative to the second side.

As illustrated in FIGS. 2-4, both the base 13 and housing 15 can have vertical planar symmetry. As used herein, a single plane may extend through both handles 16, such that the beverage container holder 11, base 13 and housing 15 have vertical planar symmetry through such a plane. Accordingly, versions of the housing 15 may be mounted to the base 13 in two different directions (e.g., orthogonal directions, 180 degrees apart).

In some embodiments (see, e.g., FIGS. 4 and 5), the base 13 may comprise a lower end 14. The base 13 can further include a skirt 18 that extends from the base adjacent the lower end 14. In some versions, bottoms of the lower end 14 and the skirt 18 can be substantially co-planar or flush, as shown. The skirt 18 may provide base 13 with additional support and stability from tipping over.

Embodiments of the base 13 may further comprise one or more (e.g., seven shown in FIG. 2, 41*a*-41*f*) interior platforms 41. The interior platforms may be configured to support a plurality of different sizes (e.g., seven different sizes) of beverage containers 101. As shown in FIG. 2, embodiments of the interior platforms 41 may comprise sets of disparate surfaces that are located at different vertical elevations relative to each other. In other examples, the interior platforms 41 may comprise sets of disparate surfaces at different horizontal displacements relative to each other. Each of the sets of interior platforms 41 at selected elevations or displacements is intended to support a selected size of beverage container 101. The upper surface of lower end 14 also may comprise one of the interior platforms 41 or sets of disparate surfaces to support at least one type of beverage container 101.

Alternatively or in addition, the interior platforms 41 may be configured as substantially rectangular blocks. In some versions, at least some of the rectangular blocks may comprise rectangular notches to provide at least one of the sets of disparate surfaces, as shown in FIG. 2.

In other embodiments, the beverage container holder 11 may include the base 13 with the flexible tab 19 and at least one vertical rib 43 (e.g., two are shown in FIG. 2). The vertical rib 43 may extend outward from the flexible tab 19 as shown. Embodiments of the housing 15 may include at least one vertical recess 45 (e.g., two are shown in FIG. 3) extending therein. The vertical ribs 43 may be configured to slidingly engage respective ones of the vertical recesses 45 to align the housing 15 on the base 13. Alternatively, the vertical ribs could be located on the housing 15, and the vertical recesses could be located on the base 13. In some versions of the vertical ribs 43, they may bisect respective ones of a plurality of the lock buttons 21. Similarly, in some versions of the vertical recesses 45, they may bisect respective ones of a plurality of the lock holes 23.

Housing 15 also may be provided with relief features 47 (FIG. 3) to permit the lock buttons 21 on base 13 to more easily pass into and out of housing 15.

Embodiments of the beverage container holder 11 may be configured such that the base 13 and the housing 15 are configured to be coaxially mounted together. Each of the base 13 and housing 15 may have a generally elliptical shape in section through a central axis 12 of the beverage container holder 11. The upper end of beverage container 11 (i.e., the upper end of housing 15) may be provided with an aperture 51 to permit access to the beverage container 101 located therein, such as with a straw. Likewise, the lower end of beverage container holder 11 (i.e., the lower end of housing 15) may be provided with an aperture 53 to permit access to the beverage container 101 located therein. The sizes and shapes of apertures 51, 53 may vary, and may include surface area sizes that are smaller than those of beverage containers, and may include shapes that differ from those of beverage containers. For example, the apertures 51, 53 may be oval, whereas many beverage containers are rectangular.

In some embodiments, the lock holes 23 comprise a single lock hole 23 configured to be selectively engaged by a plurality of the lock buttons 21. The lock holes 23 also may comprise two lock holes 23 that are substantially vertically aligned. Versions of the lock buttons 21 may comprise two sets of vertically oriented lock buttons 21. In addition, each lock hole 23 may comprise a single lock hole 23 configured to be selectively engaged with a single one of a respective set of vertically oriented lock buttons 21.

Figure 6:
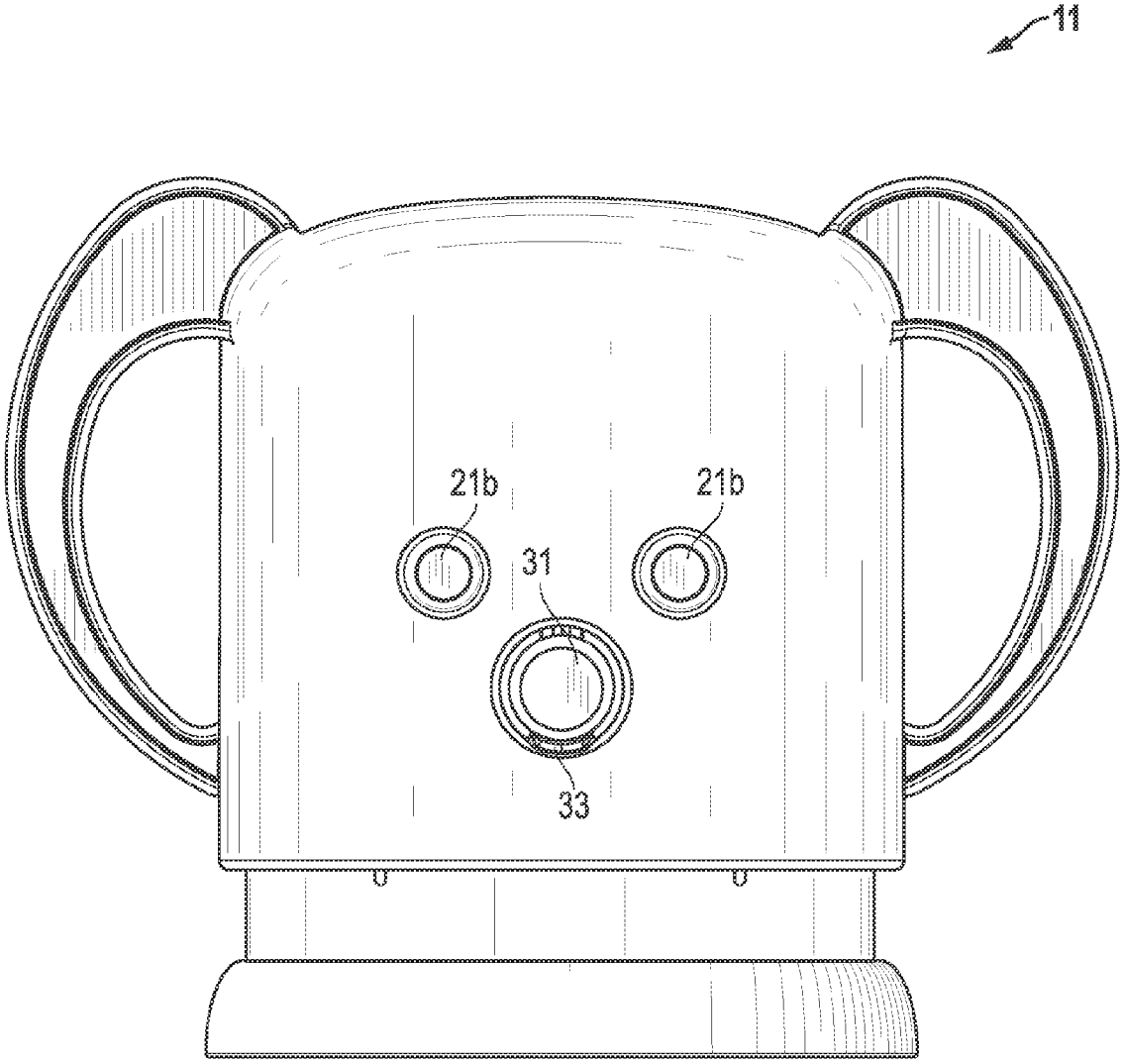
FIGS. 6-8 are front views of an embodiment of a beverage container holder in second, third and fourth positions, respectively.
Figure 7:
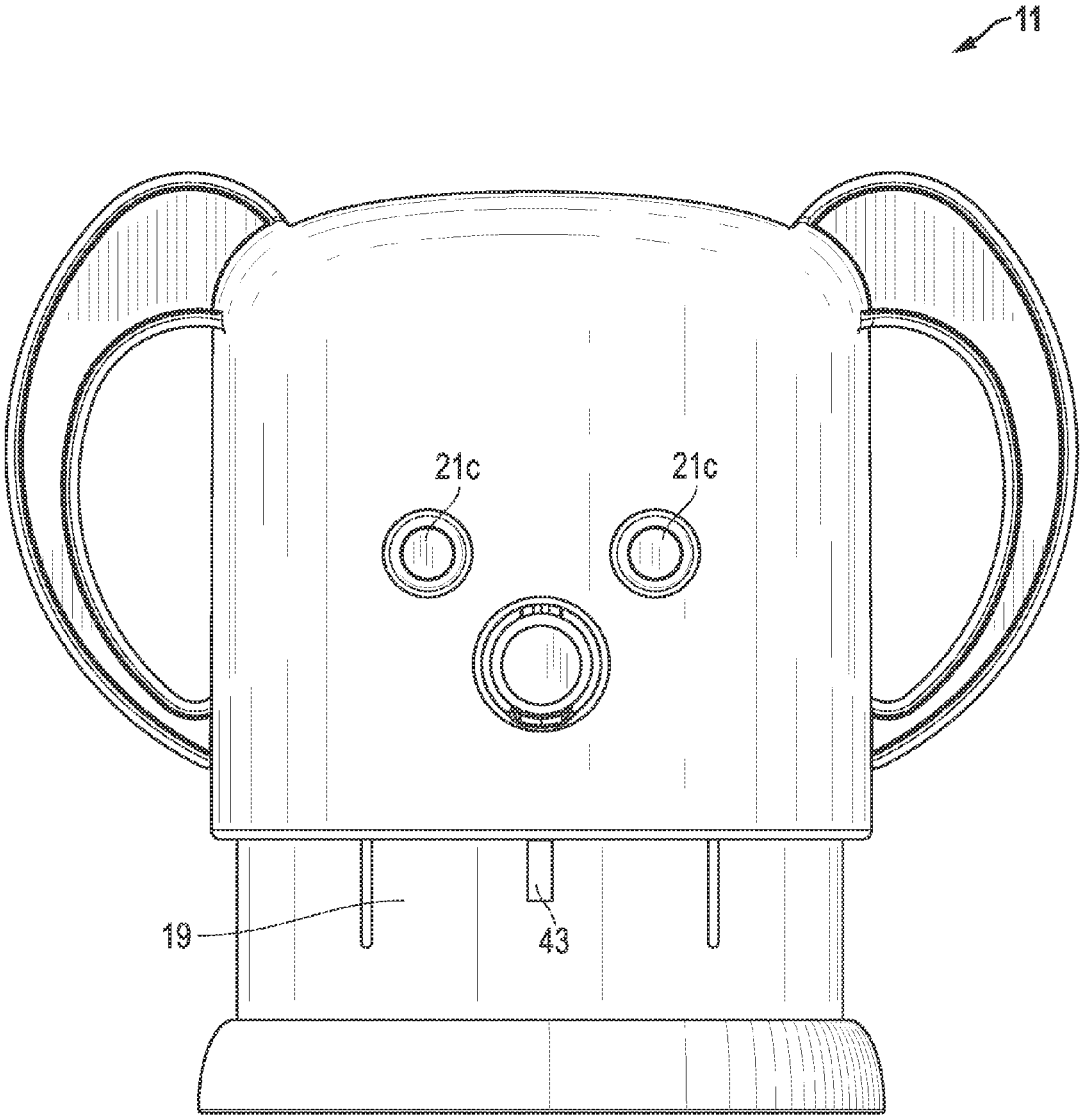
Figure 8:
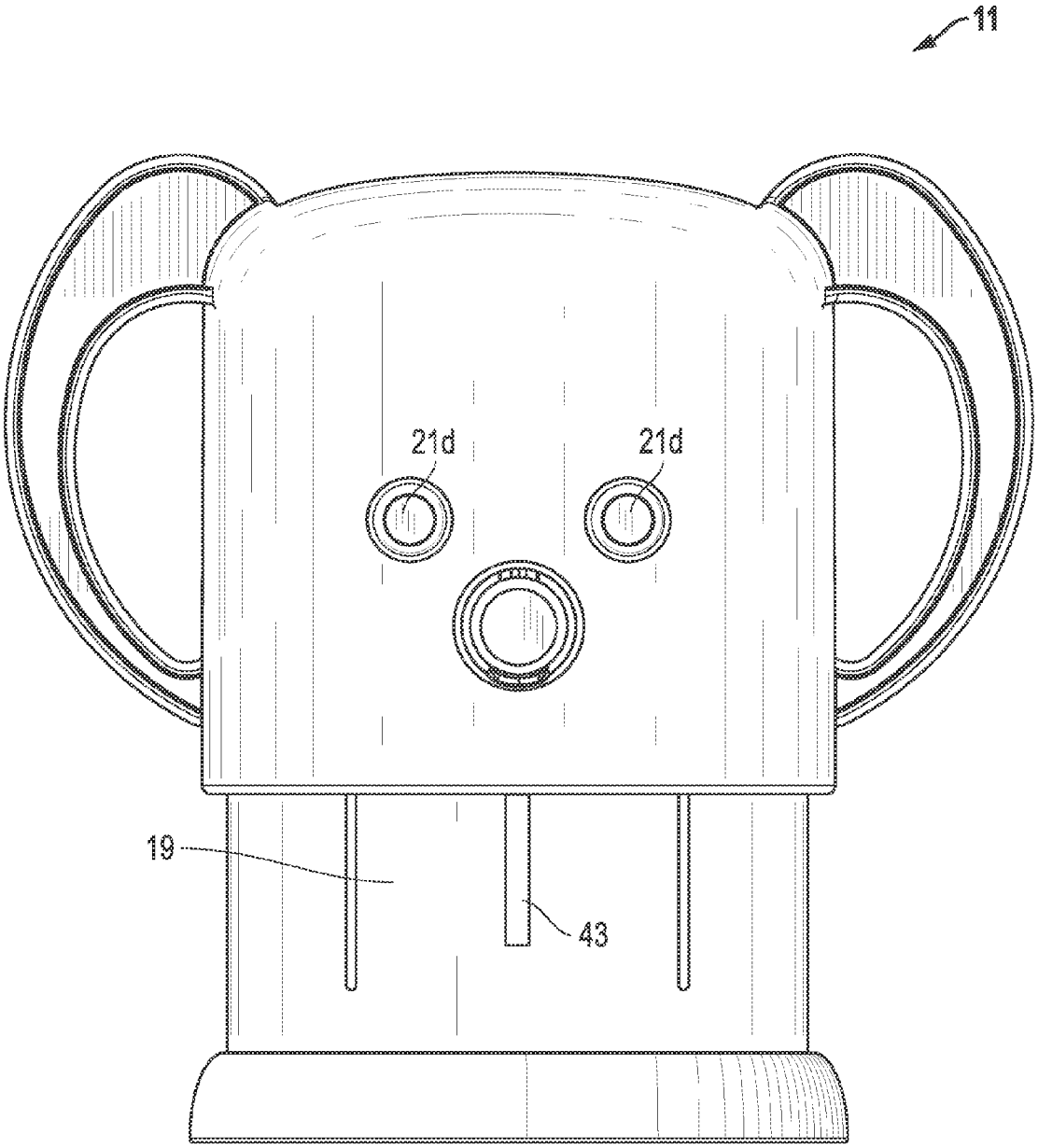

For example, FIG. 1 illustrates the beverage container holder 11 in a first position. In the illustrated first position, the lock holes 23 (e.g., four of them; two on each side) individually engage with respective ones of the lowermost lock buttons 21*a*. A second position is shown in FIG. 6, wherein the four lock holes 23 are individually engaged with respective ones of the second lock buttons 21*b*. A third position is shown in FIG. 7, wherein the four lock holes 23 are individually engaged with respective ones of the third lock buttons 21*c*. A fourth position is shown in FIGS. 4 and 8, wherein the four lock holes 23 are individually engaged with respective ones of the uppermost lock buttons 21*d*.

In an embodiment, simultaneously pressing both of the release buttons 31 on opposite sides of the beverage container holder 11 deflects the flexible tabs 19 inward. This motion can disengage the lock buttons 21 from the lock holes 23 to allow relative sliding movement between base 13 and housing 15. Such motion permits the beverage container holder 11 to adjust to different sizes of beverage containers 101, or to be disassembled.

In still another embodiment, a beverage container holder may comprise a base having an interior compartment configured to support a beverage, and a flexible tab having a lock button and a rib extending therefrom. A housing may be configured to be mounted to the base such that the beverage is located between the base and the housing, the housing having a lock hole configured to receive the lock button and secure the housing to the base, and a recess configured to slidingly receive the rib to align the housing on the base.

In yet another embodiment, a beverage container holder may comprise a base having a flexible tab with a lock button, an interior compartment, and a plurality of interior platforms in the interior compartment configured to support a plurality of different sizes of beverages. In addition, a housing may be configured to be mounted to the base such that a selected one of the different sizes of beverages is located between the base and the housing, the housing having a lock hole configured to receive the lock button and secure the housing to the base.

Figure 9:
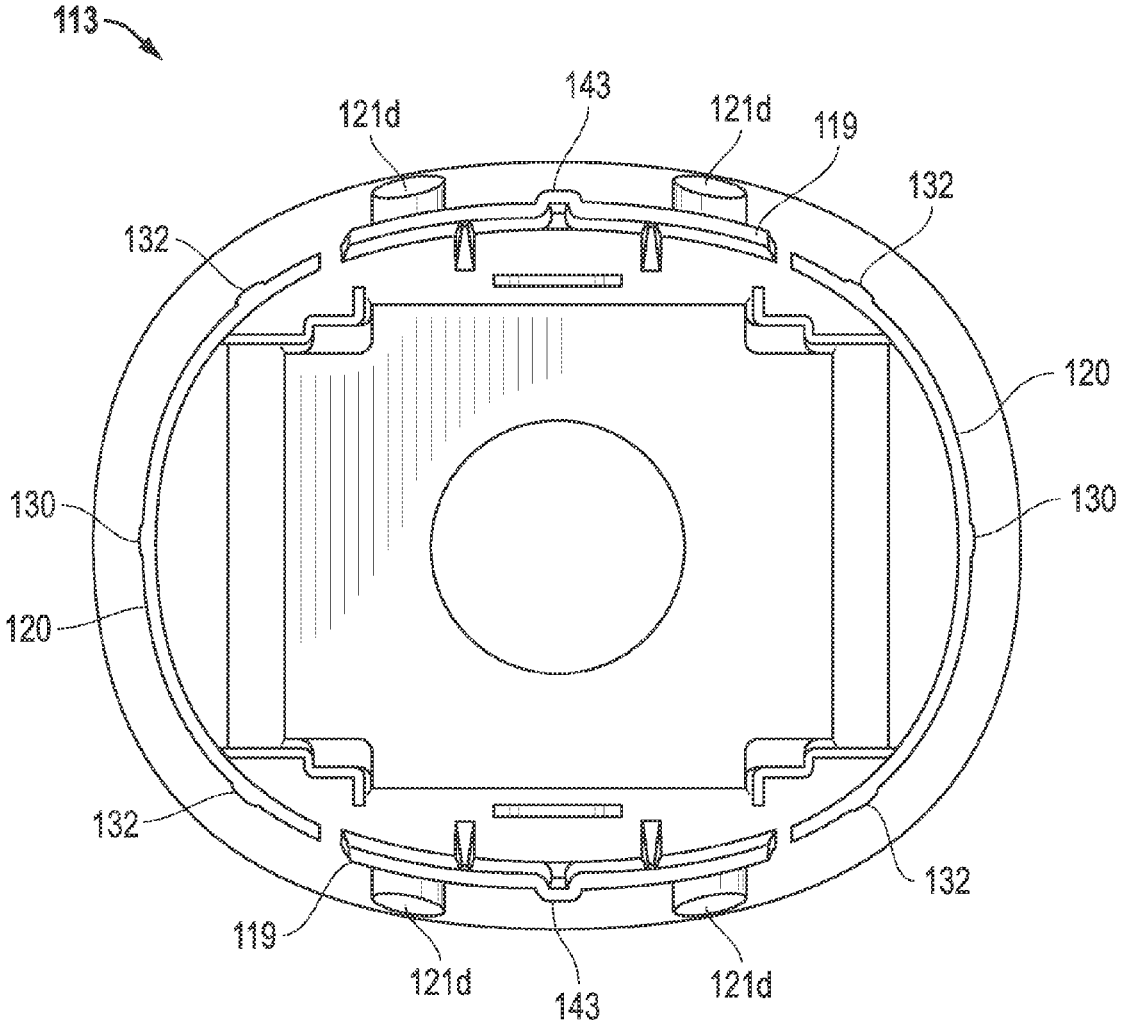
FIGS. 9 and 10 are top and side views, respectively, of an alternate embodiment of a base for a beverage container holder.
Figure 10:
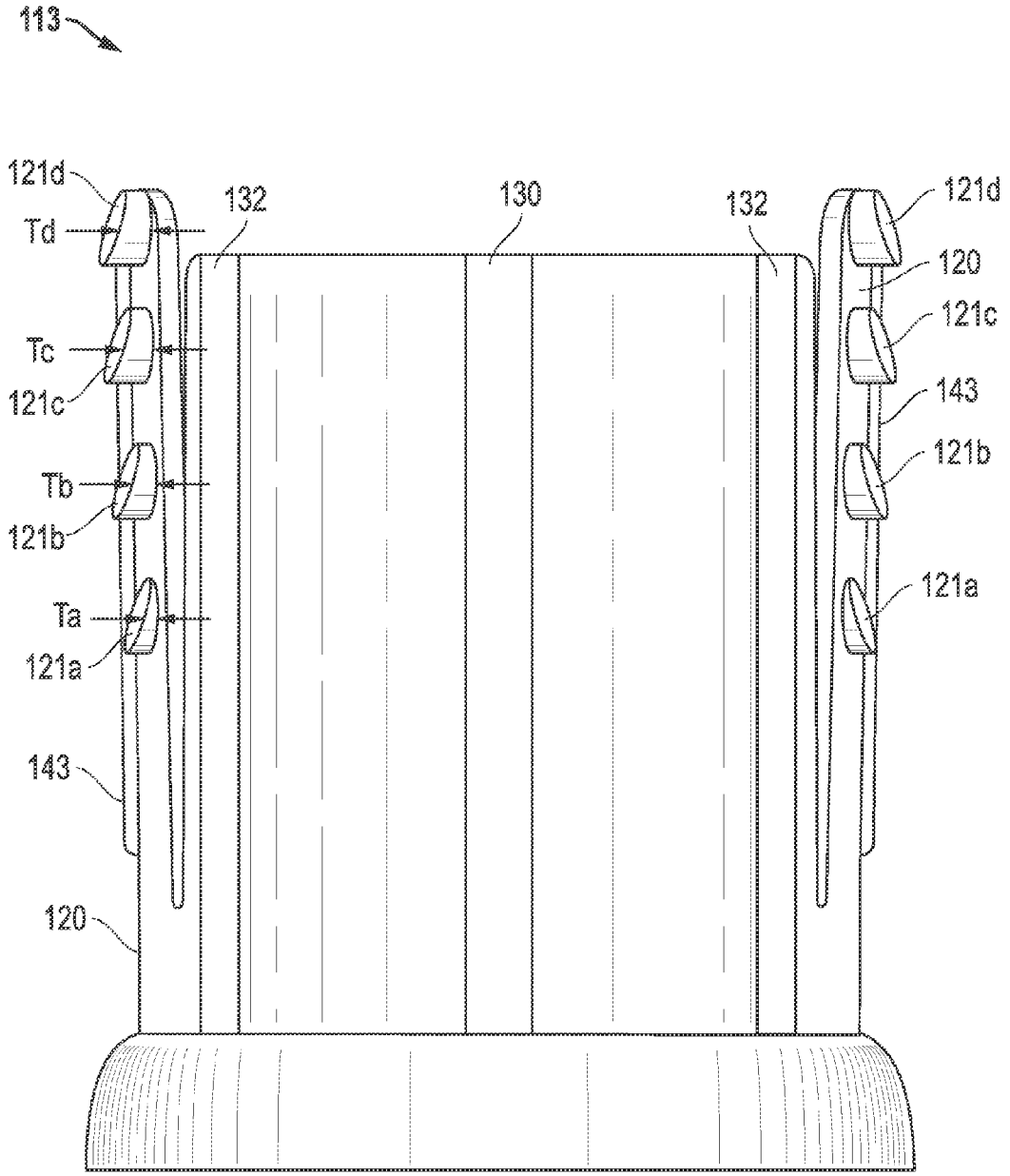

FIGS. 9 and 10 are top and side views, respectively, of an alternate embodiment of a base 113 for a beverage container holder. Base 113 is substantially identical to base 113, with a few modifications. The base 113 may include a plurality of lock buttons 121 as described elsewhere herein. In some versions, at least two of the plurality of lock buttons 121*a*, 121*b*, 121*c* and 121*d* can have different axial lengths as measured along respective ones of their axes (e.g., their cylindrical axes). For example, a lowermost one of the lock buttons 121*a* can have a shortest axial length Ta, an uppermost one of the lock buttons 121*d* can have a longest axial length Td, and an intermediate one of the lock buttons 121*b* between the lowermost and uppermost lock buttons 121*a* and 121*d* can have an intermediate axial length Tb that is greater than the shortest axial length Ta and less than the longest axial length Td. In the version illustrated, lock button 121*c* has an axial length Tc equal to Td.

Embodiments of the beverage container holder can include a base 113 having side walls 120 Like flexible tabs 119, side walls 120 can extend vertically upward from the lower end of base 113. In some versions, at least one vertical rib 130 can extend outward from each side wall 120. The vertical ribs 130 are configured to slidingly engage an interior surface of the housing (previously described). Embodiments of the side walls 120 may each include a plurality of vertical ribs 130, 132 extending outward therefrom. The vertical ribs 130, 132 may be symmetrically oriented about the base 113, as shown. In some versions, vertical ribs 130 are thicker than (protrude from side walls 120 further than) vertical ribs 132. In an embodiment, the vertical ribs 130, 132 can be parallel to each other, and/or parallel to vertical ribs 143 (previously described as vertical ribs 43).

In still other embodiments, the beverage container may comprise one or more of the following items:

Item 1. A beverage container holder, comprising:

a base having an interior compartment configured to support a beverage, and a flexible tab having a lock button extending therefrom; and a housing configured to be mounted to the base such that the beverage is located between the base and the housing, the housing having a lock hole configured to receive the lock button and secure the housing to the base, the housing also having a release button separate and spaced apart from the lock hole, the release button being configured to selectively engage the flexible tab without contacting the lock button to indirectly release the lock button from the lock hole.

Item 2. The beverage container holder of any of these items, wherein the lock button comprises a taper.

Item 3. The beverage container holder of any of these items, wherein the lock button has a first thickness at a lower end thereof, and a second thickness at an upper end thereof that is less than the first thickness.

Item 4. The beverage container holder of any of these items, wherein the lock button comprises a plurality of lock buttons, and the lock hole comprises a plurality of lock holes.

Item 5. The beverage container holder of any of these items, wherein the lock hole comprises a ramp.

Item 6. The beverage container holder of any of these items, wherein the ramp extends into an interior of the housing from the lock hole.

Item 7. The beverage container holder of any of these items, wherein the ramp is configured to engage a lower end of the lock button.

Item 8. The beverage container holder of any of these items, wherein the release button comprises a second flexible tab.

Item 9. The beverage container holder of any of these items, wherein the lock button and lock hole are substantially cylindrical and tapered.

Item 10. The beverage container holder of any of these items, wherein the housing further comprises a handle on a first side of the beverage container holder, and the lock button and the lock hole are located on a second side of the beverage container holder that is different than the first side.

Item 11. The beverage container holder of any of these items 0, wherein the first side is a left side or right side of the beverage container holder, and the second side is a front side of the beverage container holder, and the first side is substantially orthogonal to the second side.

Item 12. The beverage container holder of any of these items, wherein the base has vertical planar symmetry and the housing has vertical planar symmetry, such that the housing may be mounted to the base in two different directions.

Item 13. The beverage container holder of any of these items, wherein the base comprises a lower end and a skirt that extends from the base, and bottoms of the lower end and the skirt are substantially co-planar.

Item 14. The beverage container holder of any of these items, wherein the base further comprises a plurality of interior platforms configured to support a plurality of different sizes of beverages.

Item 15. The beverage container holder of any of these items, wherein the interior platforms comprise sets of disparate surfaces that are located at different vertical elevations relative to each other.

Item 16. The beverage container holder of any of these items, wherein the interior platforms comprise sets of disparate surfaces at different horizontal displacements relative to each other.

Item 17. The beverage container holder of any of these items, wherein the interior platforms are substantially rectangular blocks.

Item 18. The beverage container holder of any of these items, wherein at least some of the rectangular blocks comprise rectangular notches to provide at least one of the sets of disparate surfaces.

Item 19. The beverage container holder of any of these items, wherein the flexible tab of the base has a vertical rib extending outward therefrom, and the housing has a vertical recess extending therein, and the vertical rib is configured to slidingly engage vertical recess to align the housing on the base.

Item 20. The beverage container holder of any of these items, wherein the vertical rib comprises a plurality of vertical ribs, and the vertical recess comprises a plurality of vertical recesses.

Item 21. The beverage container holder of any of these items, wherein the vertical rib bisects a plurality of the lock buttons, and the vertical recess bisects a plurality of the lock holes.

Item 22. The beverage container holder of any of these items, wherein the base and the housing are configured to be coaxially mounted together, and each has a generally elliptical shape in section through the axis.

Item 23. The beverage container holder of any of these items, wherein the lock hole comprises a single lock hole configured to be selectively engaged by a plurality of the lock buttons.

Item 24. The beverage container holder of any of these items, wherein the lock hole comprises two lock holes that are substantially vertically aligned, the lock button comprises two sets of vertically oriented lock buttons, and each lock hole comprises a single lock hole configured to be selectively engaged with a single one of a respective set of vertically oriented lock buttons.

Item 25. A beverage container holder, comprising:

a base having an interior compartment configured to support a beverage, and a flexible tab having a lock button and a rib extending therefrom; and a housing configured to be mounted to the base such that the beverage is located between the base and the housing, the housing having a lock hole configured to receive the lock button and secure the housing to the base, and a recess configured to slidingly receive the rib to align the housing on the base.

Item 26. A beverage container holder, comprising:

a base having a flexible tab with a lock button, an interior compartment, and a plurality of interior platforms in the interior compartment configured to support a plurality of different sizes of beverages; and a housing configured to be mounted to the base such that a selected one of the different sizes of beverages is located between the base and the housing, the housing having a lock hole configured to receive the lock button and secure the housing to the base.

Item 27. The beverage container holder of any of these items, wherein at least two of the plurality of lock buttons have different axial lengths as measured along respective ones of their axes.

Item 28. The beverage container holder of any of these items, wherein a lowermost one of the lock buttons has a shortest axial length, an uppermost one of the lock buttons has a longest axial length, and an intermediate one of the lock buttons between the lowermost and uppermost lock buttons has an intermediate axial length that is greater than the shortest axial length and less than the longest axial length.

Item 29. The beverage container holder of any of these items, wherein the base has side walls and at least one vertical rib extending outward from each side wall, and the vertical ribs are configured to slidingly engage an interior surface of the housing.

Item 30. The beverage container holder of any of these items, wherein each side wall has a plurality of vertical ribs extending outward therefrom, and the vertical ribs symmetrically oriented about the base.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A beverage container holder, comprising:

a base having an interior compartment configured to support a beverage, and a flexible tab having a lock button extending therefrom; and a housing configured to be mounted to the base such that the beverage is located between the base and the housing, the housing having a lock hole configured to receive the lock button and secure the housing to the base, the housing also having a release button separate and spaced apart from the lock hole, the release button being configured to selectively engage the flexible tab without contacting the lock button to indirectly release the lock button from the lock hole.

2. The beverage container holder of claim 1, wherein the lock button comprises a plurality of lock buttons, and the lock hole comprises a plurality of lock holes.

3. The beverage container holder of claim 1, wherein the lock hole comprises a ramp.

4. The beverage container holder of claim 3, wherein the ramp extends into an interior of the housing from the lock hole.

5. The beverage container holder of claim 3, wherein the ramp is configured to engage a lower end of the lock button.

6. The beverage container holder of claim 1, wherein the release button comprises a second flexible tab.

7. The beverage container holder of claim 1, wherein the lock button and lock hole are substantially cylindrical and tapered.

8. The beverage container holder of claim 1, wherein the housing further comprises a handle on a first side of the beverage container holder, and the lock button and the lock hole are located on a second side of the beverage container holder that is different than the first side.

9. The beverage container holder of claim 8, wherein the first side is a left side or right side of the beverage container holder, and the second side is a front side of the beverage container holder, and the first side is substantially orthogonal to the second side.

10. The beverage container holder of claim 1, wherein the base has vertical planar symmetry and the housing has vertical planar symmetry, such that the housing may be mounted to the base in two different directions.

11. The beverage container holder of claim 1, wherein the base comprises a lower end and a skirt that extends from the base, and bottoms of the lower end and the skirt are substantially co-planar.

12. The beverage container holder of claim 1, wherein the base further comprises a plurality of interior platforms configured to support a plurality of different sizes of beverages.

13. The beverage container holder of claim 12, wherein the interior platforms comprise sets of disparate surfaces that are located at different vertical elevations relative to each other.

14. The beverage container holder of claim 12, wherein the interior platforms comprise sets of disparate surfaces at different horizontal displacements relative to each other.

15. The beverage container holder of claim 12, wherein the interior platforms are substantially rectangular blocks.

16. The beverage container holder of claim 15, wherein at least some of the rectangular blocks comprise rectangular notches to provide at least one of the sets of disparate surfaces.

17. The beverage container holder of claim 1, wherein the flexible tab of the base has a vertical rib extending outward therefrom, and the housing has a vertical recess extending therein, and the vertical rib is configured to slidingly engage vertical recess to align the housing on the base.

18. The beverage container holder of claim 1, wherein the base and the housing are configured to be coaxially mounted together, and each has a generally elliptical shape in section through the axis.

19. The beverage container holder of claim 1, wherein the lock hole comprises a single lock hole configured to be selectively engaged by a plurality of the lock buttons.

20. The beverage container holder of claim 1, wherein the lock hole comprises two lock holes that are substantially vertically aligned, the lock button comprises two sets of vertically oriented lock buttons, and each lock hole comprises a single lock hole configured to be selectively engaged with a single one of a respective set of vertically oriented lock buttons.

* * * * *